United States Patent [19]

Nestle et al.

[11] Patent Number: 4,915,680

[45] Date of Patent: Apr. 10, 1990

[54] FLOATING ADUSTABLE GUSSETING WHEEL

[75] Inventors: Robert J. Nestle, Essexville; David A. Barker, Midland, both of Mich.

[73] Assignee: The Dow Chemical Company, Midland, Mich.

[21] Appl. No.: 260,644

[22] Filed: Oct. 21, 1988

[51] Int. Cl.[4] ..... B65H 45/22

[52] U.S. Cl. ..... 493/417; 493/439

[58] Field of Search ..... 493/254, 394, 424, 439, 493/442, 417

[56] References Cited

U.S. PATENT DOCUMENTS

| | | |
|---|---|---|
| Re. 28,959 | 9/1976 | Naito . |
| 2,641,166 | 7/1952 | Morrell . |
| 3,503,112 | 1/1967 | Siegel . |
| 3,584,545 | 5/1971 | Ehlscheid . |
| 3,678,813 | 7/1972 | Wech . |
| 4,094,729 | 6/1978 | Boccia . |
| 4,417,883 | 11/1983 | Granger et al. . |
| 4,650,455 | 3/1987 | Kondo ..... 493/424 |

*Primary Examiner*—Frederick R. Schmidt
*Assistant Examiner*—Jack Lavinder
*Attorney, Agent, or Firm*—J. Robert Dean Jr.

[57] ABSTRACT

Disclosed is an apparatus for introducing a gusset into a web of plastic film. The apparatus includes a pneumatically-biased protruding plate which varies the depth of the gusset to maintain a constant protruding plate-film web tension in response to variations in the transverse width of the film web. Further disclosed is a means for holding the zipper laterally stationary and in alignment while the gusset is introduced into the film web by the same apparatus.

11 Claims, 2 Drawing Sheets

FLOATING ADUSTABLE GUSSETING WHEEL

BACKGROUND

This invention addresses the problem of variations in the tranverse width of a plastic film web in a gusseting process. A shortening of the transverse width of the web can result in a severing or tearing of the web or misalignment and lack of symmetry among the layers of the web.

Gusseted plastic bags are typically manufactured from a substantially continuous sheet of plastic film folded in half to form a multilayer film web. Each layer of film may comprise one or more plies of plastic or plastic compatible material. The edge of the film web opposite the folded-over edge portion may be open-ended or closed by fastening means such as a zipper.

A gusset is formed when the folded-over edge portion is folded inward into the film web to form gusset folds along the affected film web fold portion. Numerous gusset fold configurations including bi-fold and tri-fold are possible. The film web may then be heat sealed to form individual gusseted bags. Upon filling of the gusseted bag, the gusset folds expand to reveal side or bottom walls of dimension equivalent to the width of the folds when opened. Gusseted plastic bags have advantages over ungusseted plastic bags in that they may stand upright upon filling.

Numerous gusseting apparatuses are known in the prior art, including Piazze, U.S. Pat. No. 3,618,478, which relates to the gusseting of an open-ended web. A typical apparatus usually comprises a pair of generally aligned, closely-spaced plates positioned inside the film web contiguous to the interior face of folded-over web edge portion, with another plate, preferably in the shape of a wheel, positioned a certain distance therebetween from the external face of the folded-over web edge portion inward.

Variations in the transverse width of the web can result in misalignment of the web or the layers of the web with respect to each other. This can result in tearing or excessive variation in the depth of the bag or lack of symmetry among the layers of the bag or the gusset folds. If the web has a zipper, misalignment may result in difficulties in separation, closure, and alignment of the rib and groove profiles of the zipper.

Variations in transverse width are more prevalent in both number and magnitude in film webs produced by blown extrusion processes than film produced in cast extrusion processes, but are present to a certain degree in all film webs.

A representative prior art gusseting apparatus which compensates for variations in the transverse width of the web is related by Wech, U.S. Pat. No. 3,618,813. Wech relates a resiliently-biased wheel positioned a certain distance between two plates with the preferred means of resilience being a spring. When tension exerted on the film by the plates and the wheel positioned therebetween becomes greater than the compressive force of the biasing spring, the wheel is forced backwards a distance sufficient to equalize the tension and the compressive force.

The shortcomings of spring-biased gusseting wheels known in the prior art include difficulty of controlling and selecting the desired tension level of the wheel, variation in spring force as a function of spring displacement, and the tendency of the spring to bias continually or continuously or "wave" around the tension-spring force equilibrium point during the gusseting operation.

An element of uncertainty is involved in setting a spring-biased gusseting wheel at uniform preload; the desired tension must be manually set by manipulation of a mechanical adjusting device on the basis of visual observation of the depth of the gusset.

Variation in spring force as a function of spring displacement is critical since spring displacement is necessary to relieve tension between the film and the protruding plate. If, upon compression or stretching of the spring, the spring force increases significantly over the displacement, then the spring, and, thus, the protruding plate or gusseting wheel, may not bias to a sufficient degree to adequately relieve tension between the film and the protruding plate. If the tension cannot be relieved, then a severing or puncturing of the film by the edge of the protruding plate or misalignment of the layers of the film web is possible. At the very least, variation in spring force creates uncertainty as to determination of desirable gusset depths for a given spring utilized in the gusseting apparatus.

The tendency of the spring to "wave" around the tension-spring force equilibrium point during the gusseting operation is the most critical problem associated with the spring-biased protruding plate. Waving of the spring results from a lack of intrinsic dampening characteristics in the system.

The phenomena of waving arises as follows: the protruding plate or gusset wheel biases in reaction to a change in the transverse width of the web, the biasing motion has an intrinsic momentum which creates an alternating tensile stretching and compression motion within the spring that dissipates according to intrinsic dampening characteristics of the gusseting apparatus and the spring itself. The problem with relying upon the intrinsic dampening ability of the spring to dissipate waving is that variations in transverse width of the film web arise often enough to create continuous or at least very frequent continual biasing or waving of the protruding plate or gusset wheel.

Process problems and difficulties brought on by waving include excessive variation in bag and gusset depth and lack of symmetry among the gusset folds.

Variation in bag and gusset depth along lengths of film web due to waving occurs because the spring will wave or bias around any given tension-spring force equilibrium point whether there has been a change in the transverse width of the film web or not.

Lack of symmetry among the gusset folds due to waving occurs when the gusseting wheel or protruding plate is on its outward motion. The temporary excessive slack in the film web can become unevenly distributed between the receiving plates resulting in adjacent gusset folds having differing depths with respect to each other.

SUMMARY OF THE INVENTION p The invention disclosed herein discloses an improved apparatus for introducing a gusset into a sequentially advancing, continuous, folded-over web of plastic film. The apparatus employs a pneumatically-biased protruding plate or gusseting wheel, which applies a constant yet adjustable pressure to the exterior of the folded-over edge portion of the web being gusseted and receiving plates, which are positioned contiguous to the interior of the folded-over edge portion of the web. The protruding plate laterally "floats" or biases between the receiving plates as necessary to equalize the applied pressure of the biasing means and the tension between the protruding plate and the web as the tension varies according to variations in the transverse width of the web.

Further disclosed is the apparatus of the present invention in combination with a means for holding a zipper of a film web laterally stationary and in alignment at the point in which the gusset is being introduced into the film web. The means comprises a zipper profile guide having narrow pathways traversing the upper and lower surfaces of the guide in the machine direction. The profile guide separates the rib and groove profiles of the zipper and maintains them in vertical alignment as the gusset is formed at substantially the same point lengthwise on the opposite side of the film web.

BRIEF DESCRIPTION OF THE DRAWINGS

The novel features of the present invention and the context within which they are set will be better understood upon reviewing the following specification together with the several drawings in which the same reference numbers are employed for the same parts in the various views and wherein.

DETAILED DESCRIPTION OF THE INVENTION

Figure 1:
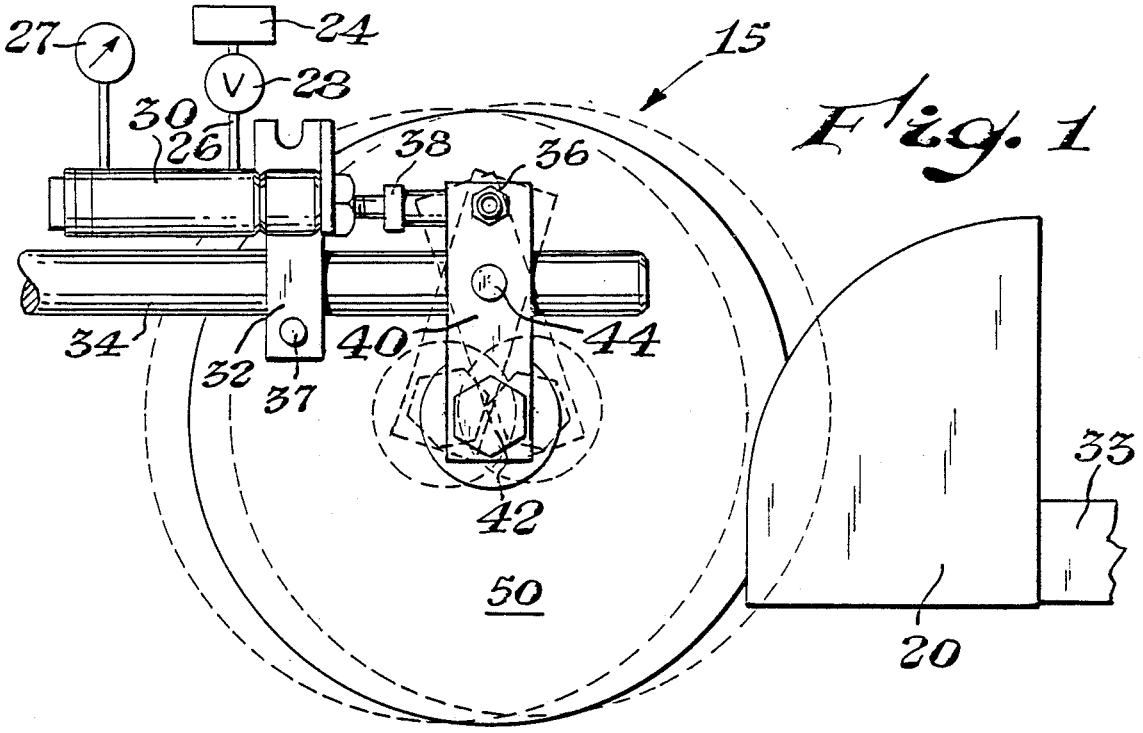
FIG. 1 is a plan view of the apparatus made in accordance with the present invention.
Figure 2:
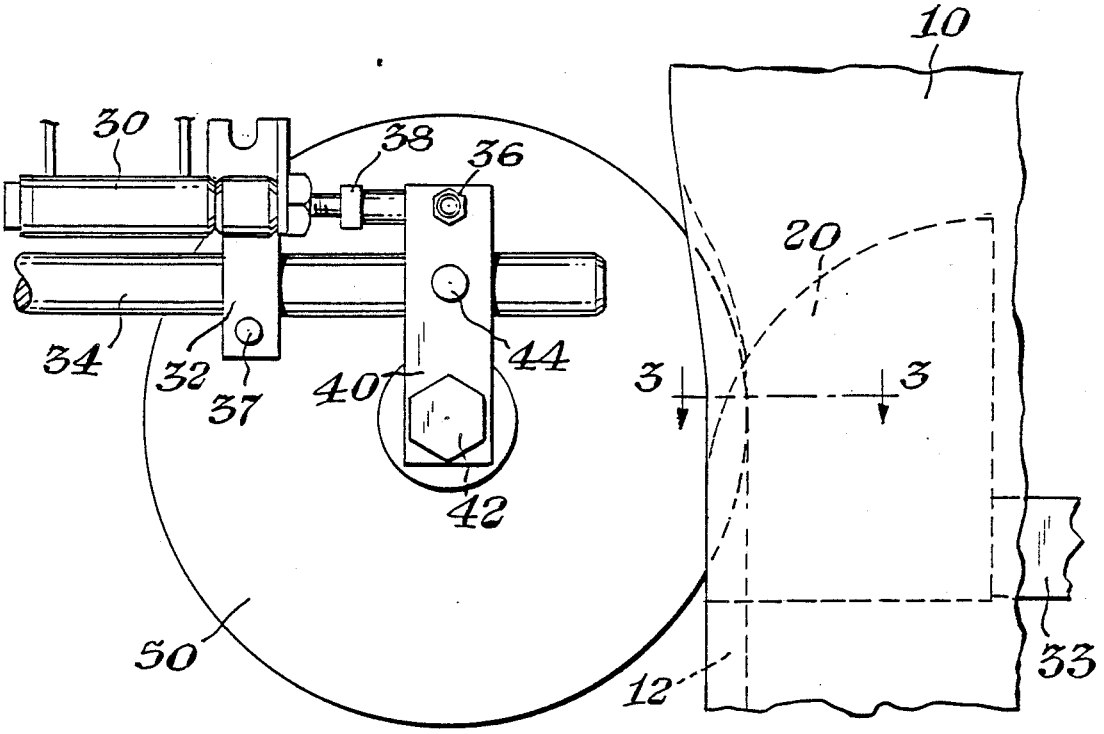
FIG. 2 is a fragmentary plan view of the apparatus of FIG. 1 in cooperation with a film web.

Referring to FIGS. 1 and 2, an apparatus 15 for introducing a gusset 12 into a sequentially advancing, continuous, folded-over web 10 of plastic film comprises receiving plates 20, a protruding plate or gusseting wheel 50, a pneumatic biasing means, the pneumatic biasing means being capable of applying a substantially constant pressure, and a means for connecting the protruding plate and pneumatic biasing means.

Receiving plates 20, usually two in number but which can be more depending upon the desired configuration of gusset 12, are generally parallel and aligned with respect to each other. Receiving plates 20 are positionally secured with respect to each other and to the remainder of apparatus 15 of the present invention by a rigid bar 33. Bar 33 is preferably comprised of metal, but may be constructed of a finished wood or a hard plastic or similar strong material.

Protruding plate 50, usually one in number but which can be more again depending upon the desired configuration of gusset 12, is generally parallel to and equidistant from receiving plates 20, and protrudes to some degree therebetween. The extent of protrusion by protruding plates 50 and number of receiving plates 20 and protruding plates 50 is determinative of the width of formed gusset 12. The gusset 12 unfolds to form a flat, generally planar surface.

Figure 3:
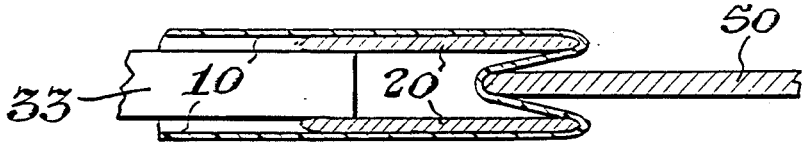
FIG. 3 is a fragmentary cross-sectional view along line 3—3 of the apparatus of FIG. 2 in cooperation with the receiving plates and the film web.

Receiving plates 20 are positioned inside web 10 contiguous to the interior of a folded-over edge portion of web 10 to be gusseted as shown in FIG. 3. Protruding plate 50 is positioned contiguous to the exterior of folded-over edge portion of web 10 to be gusseted such that web 10 follows the protrusion of protruding plate 50 into the space between receiving plates 20.

The preferred material of construction of receiving plates 20 and protruding plate 50 is metal, though any rigid material such as a hard plastic or a finished wood may be utilized.

The preferred shape of protruding plates 50 is thin and circular, though any other shape such as obloidal capable of forming gusset 12 without damaging the physical integrity of passing film web 10 may be utilized. The size of protruding plates 50 is not critical so long as it is of sufficient length, width, or radius to form gusset 12 of desired depth.

The preferred shape of receiving plates 20 is that of a gull wing, though any shape such as a rectangle or a square which is capable of forming gusset 12 without damaging the physical integrity of web 10 may be utilized. Any corners or edges of the protruding plates 50 or receiving plates 20 coming into contact with web 10 are preferably rounded or smoothed off. The size of receiving plates 20 is not critical so long as they are of sufficient length and width to form gusset 12 of desired depth.

Tension between protruding plate 50 and web 10, which results from the juxtapositioning of web 10 between receiving plates 20 and protruding plate 50 situated therebetween, is determinative of the extent of protrusion of protruding plate 50 between the receiving plates 20. When the transverse width of the film web 10 decreases, resulting in increased tension between protruding plate 50 and web 10, protruding plate 50 will recede until such tension equals the pressure being applied by pneumatic biasing means. Receding of protruding plate 50 results in a decrease in width of gusset 12. When the transverse width of film web 10 increases, protruding plate 50 will bias inward into the space between receiving plates 20 until tension and pressure are equalized. The result of this inward bias is an increase in the width of gusset folds 13 and gusset 12 itself.

Pneumatic biasing means is preferably an air cylinder 30 capable of delivering a constant pressure, and most preferably an air cylinder 30 of the spring-extend air retract type. When air cylinder 30 is at zero air pressure, an internal spring within cylinder 30 biases cylinder extension 38 outward to full degree (not shown). When air cylinder 30 is charged with air, the air operates against the internal spring (not shown) and forces cylinder extension 38 to retract to a degree commensurate with the air pressure of cylinder 30. The spring-extend air retract type of air cylinder 30 is preferred because operation of opposing forces within air cylinder 30 allows for superior controlability, and depressurization of cylinder 30 for any reason results in retraction of protruding plate 50 from film web 10 and receiving plates 20.

Figure 4:
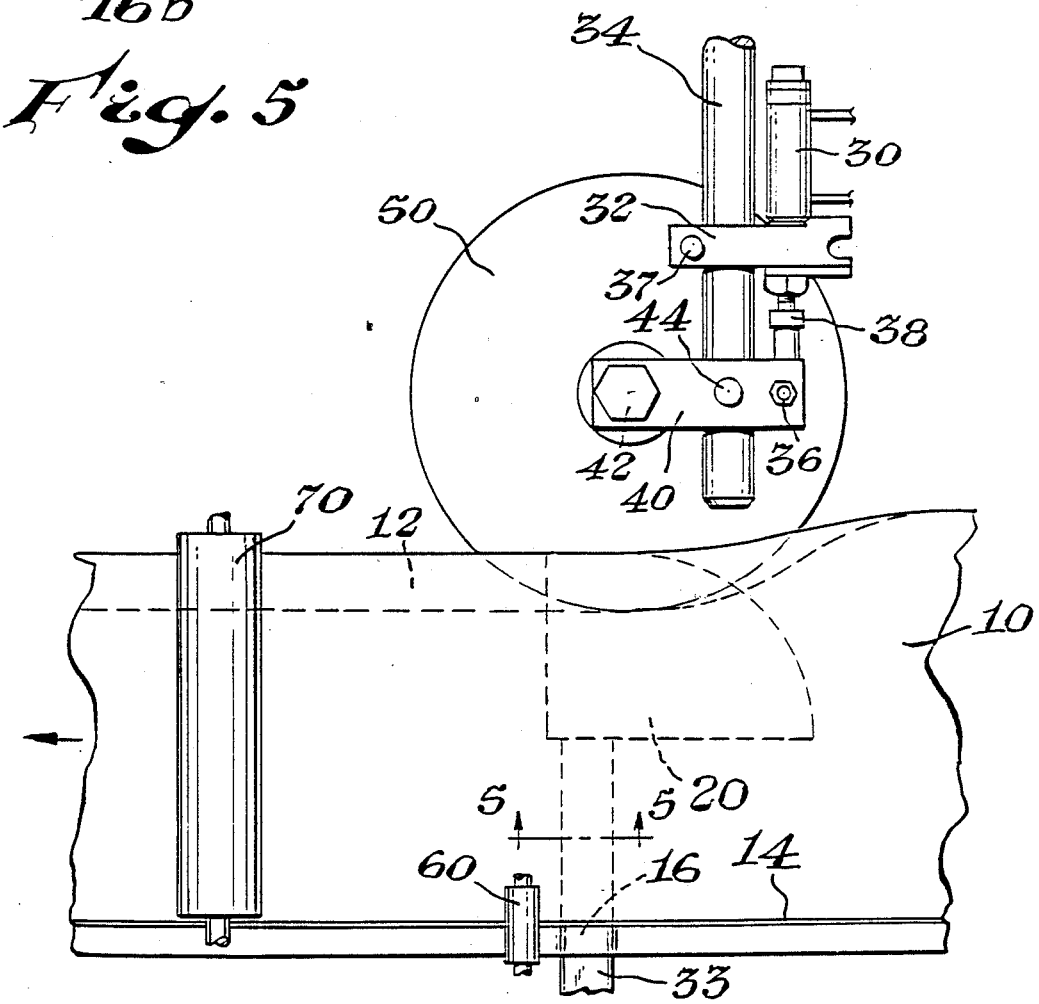
FIG. 4 is a fragmentary plan view of the apparatus of FIG. 1 in cooperation with nip rollers, closure rollers, a zipper profile guide, and a film web having a zipper.

The preferred means for connecting protruding plate 50 and air cylinder 30 is illustrated in FIGS. 1, 2, and 4. Air cylinder 30 is secured by a cylinder bracket 32, which is secured therearound to a stationary brace 34 by a stationary nut and bolt assembly 37. Stationary brace 34 directly and indirectly provides a rigid mounting for apparatus 15 of the present invention. A crosspiece 40 is pivotally connected to stationary brace 34 at a middle portion of crosspiece 40 at a pivoting nut and bolt assembly 44. Air cylinder 30 has a cylinder extension 38, which is pivotally connected to an end portion of crosspiece 40 at a pivoting nut and bolt assembly 36. Protruding plate 50 is connected to crosspiece 40 by an adjusting nut and bolt assembly 42 at an end portion of crosspiece 40 longitudinally opposite that of cylinder extension 38. Assembly 42 affords variable vertical adjustment of protruding plate 50 along the axis of assembly 42 to allow for variable vertical adjustment of plate 50 between receiving plates 20. Further, assembly 42 may be either stationary or rotatable, but is most preferably stationary to minimize vibration of protruding plate 50 when apparatus 15 is in operation.

Most preferably, crosspiece 40 is pivotally connected to stationary brace 34 at a middle portion about one-third of the distance from pivoting nut and bolt assembly 44 to adjusting nut and bolt assembly 42 to provide a fulcrum which allows disproportionate extension and movement of protruding plate 50 versus that of cylinder extension 38 of air cylinder 30. A given angular displacement of protruding plate 50 about the fulcrum results in a corresponding angular displacement of only about half that for cylinder extension 38. This disparity in relative angular displacement is desirable because it makes the device more sensitive to tension variations between film 10 and protruding plate 50. Also, air cylinder 30 may be operated at a wider range of pressures than would be possible with the fulcrum at the midpoint of crosspiece 40. Operation at a wider range of pressures allows for finer adjustment of depth of gusset 12.

Air cylinder 30 is provided with air by an air supply means 24 through an air supply conduit means 26 and an air supply regulating means 28. Air supply means 24 provides air at a higher pressure than is desirable within air cylinder 30 itself. Air supply conduit 26 provides a pathway for flow of air or maintenance of air pressure from supply means 24 to air cylinder 30. Regulating means 28 steps the supply air pressure down to the level desired within air cylinder 30. A pressure gauge 25 in integral connection with the internal air of air cylinder 30 allows continuous indication of air pressure within same.

A suitable air cylinder 30 is the Bimba Model 020.5R distributed by the Bimba Manufacturing Co., the cylinder having a diameter of 9/16 inch and a crossection of 0.25 square inches. The Bimba cylinder preferably operates at about 15–30 pounds per square inch pressure, and most preferably at about 21 pounds per square inch pressure. Air supply means 28 preferably supplies an air pressure of from about 80–90 pounds per square inch.

Air cylinder 30 can be directly connected to protruding plate 50 instead of utilizing crosspiece 40 as a lever. Direct connection requires operation of biasing means 30 at lower pressures due to the one to one equivalence between relative displacements of protruding plate 50 and biasing means 30 as described above, thus reducing apparatus 15 sensitivity.

Air cylinder 30 offers considerable advantages over spring biasing means known in the prior art. These advantages include uniform selectivity of preload, uniform load regardless of the position of protruding plate 50, and an intrinsic dampening characteristic which substantially reduces or eliminates the process problem of "waving" of protruding plate 50.

Uniform selectivity of preload is also enhanced by use of cylinder 30 because gas pressure is easily measurable by conventional means such as gauge 25. A given gas pressure corresponds to a given force of protruding plate 50.

Air cylinder 30 exerts a uniform load on film web 10 through protruding plate 50 regardless of the position of protruding plate 50 because the impetus of the load, the air pressure within cylinder 30, can flow in or out thereof. In contrast, the load exerted by a spring varies according to the displacement of the spring from its equilibrium point.

The intrinsic characteristic of air cylinder 30 which eliminates the "waving" of protruding plate 50 is its dampened response to changes in tension between protruding plate 50 and film web 10 due to residual air pressure within cylinder 30. When protruding plate 50 biases outward in response to greater tension from film web 10 due to narrowing of the transverse width of web 10, crosspiece 40 forces cylinder extension 38 of cylinder 30 outward resulting in compression of the air within cylinder 30. This compression of the air is short-lived since it stabilizes with the air from supply means 24 through conduit means 26 as controlled by regulating means 28. However, this short-lived compression briefly delays the response of cylinder 30 providing a dampening effect. This dampening effect delays the response time of protruding plate 50, but does not dampen the magnitude of response. Similarly, when protruding plate 50 biases inward in response to broadening of the transverse width of film web 10, the expansion of air within air cylinder 30 dampens the response time of protruding plate 50, but does not dampen the magnitude of response. The dampened response time of air cylinder 30 substantially reduces or eliminates waving of protruding plate 50 by substantially reducing the momentum shifts resulting from variations in transverse width of film web 10 and residual waving. Zipper 14 comprises a rib profile and a groove profile (not shown) which can be separated or interlocked such as in U.S. Pat. No. 4,561,109, Herrington.

FIG. 4 shows apparatus 15 of the present invention for introducing gusset 12 into film web 10 having a zipper 14 therein in combination with a means for holding zipper 14 laterally stationary and in alignment at the point in which gusset 12 is being introduced into film web 10. Laterally stationary and in alignment means that the zipper travels in substantially the same path before the introduction of gusset 12 into film web 10, during the introduction of gusset 12, and after the introduction of gusset 12.

Figure 5:
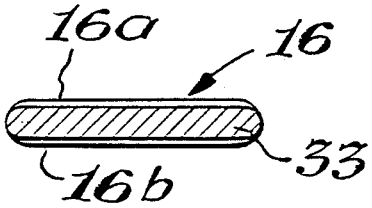
FIG. 5 is a cross-sectional view along line 5—5 of FIG. 4 of the zipper profile guide.

FIG. 5 illustrates a preferred means for holding zipper 14 laterally stationary and in alignment comprising a zipper profile guide 16 defined in stationary bar 33. Zipper profile guide 16 comprises shallow, narrow pathways **16*a* and 16*b* traversing the upper and lower surfaces of bar 33 in the machine direction. The rib and groove profiles are separated at profile guide 16, guided and held in alignment along the pathways 16*a* and 16*b*, which are retentionally coextensive therewith, and subsequently re-interlocked by a pair of closely adjacent closure rollers 60 through which the rib and groove profiles of zipper 14 are passed. Separation and maintenance of alignment of rib and groove profiles of zipper 14 are desirable to ensure alignment of film web 10, even depth of gusset 12, and symmetry of gusset 12 as gusset 12 is being introduced into film web 10. Separation and reinterlocking of the rib and groove profiles of zipper 14 are further desirable to provide a means for allowance of interchange of air between the interior of film web 10 and the ambient environment. A pair of closely adjacent nip rollers 70 through which film web 10** passes prevent further passage of entrapped air.

While the preferred embodiments of the invention have been shown with regard to specific design details in gusseting apparatus 15, it will be appreciated that depending upon the design and the manufacturer's desires, the invention may be modified by various changes while still being fairly within the scope of the general teachings and principles thereof.

What is claimed is:

1. Apparatus for introducing a gusset into a sequentially advancing, continuous, folded-over web of plastic film of varying width, comprising aligned and spaced-apart receiving plates over which the film web passes, a protruding plate located generally equidistantly between the receiving plates and generally parallel thereto and around which the film web is intended to pass, a pneumatic biasing means for applying a substantially constant pressure to the film web to form said gusset when the web width changes during advancement of the web, and a means for connecting the protruding plate to the biasing means.

2. The apparatus of claim 1, wherein the protruding plate is generally circular in shape.

3. The apparatus of claim 1, wherein the protruding plate is of metallic construction.

4. The apparatus of claim 1, wherein the biasing means is an air cylinder.

5. The apparatus of claim 4, wherein the air cylinder is a spring-extend air retract type.

6. The apparatus of claim 1, wherein the means for connecting the protruding plate and the biasing means comprises a crosspiece and a stationary brace, the crosspiece having a middle portion and end portions longitudinally oppositely situated about the middle portion, the crosspiece being pivotally mounted at its middle portion to the stationary brace, the biasing means being pivotally connected to the end portion of the crosspiece, and the protruding plate being connected to the end portion opposite that of the biasing means.

7. The apparatus of claim 1, wherein the biasing means is capable of biasing into or away from the film web while maintaining the substantially constant pressure.

8. Apparatus for introducing a gusset into a sequentially advancing, continuous, folded-over web of plastic film of varying width having a zipper with rib and groove profiles, comprising aligned and spaced-apart receiving plates over which the film web passes, a protruding plate located generally equidistantly between the receiving plates and generally parallel thereto and around which the film web is intended to pass, a pneumatic biasing means for applying a substantially constant pressure to the film web to form said gusset when the web width changes during advancement of the web, a means for connecting the protruding plate to the biasing means, and a means for holding the zipper laterally stationary and in alignment during the introduction of the gusset into the web.

9. The apparatus of claim 8, wherein the means for holding the zipper laterally stationary and in alignment comprise separate, vertically-aligned narrow pathways retentionally coextensive with each of the rib and groove profiles, the pathways being directionally aligned with the zipper and situated opposite the protruding plate.

10. The apparatus of claim 8, wherein the biasing means is capable of biasing into or away from the film web while maintaining the substantially constant pressure.

11. A method for introducing a gusset into a sequentially advancing, continuous, folded-over web of plastic film of varying width having a zipper with rib and groove profiles, comprising the steps of: locating the web over receiving plates and around a protruding plate, forming a gusset under a substantially constant pressure between the receiving plates and the protruding plate, when the web width changes during advancement of the web and holding the zipper laterally stationary and in alignment during the introduction of the gusset into the web.

* * * * *